US005466327A

United States Patent [19]

Staniszewski

[11] Patent Number: 5,466,327

[45] Date of Patent: Nov. 14, 1995

[54] ENVELOPE-FLAP SEALING DEVICE

[75] Inventor: Tadeusz Staniszewski, Budd Lake, N.J.

[73] Assignee: Shap, Inc., Demarest, N.J.

[21] Appl. No.: 322,983

[22] Filed: Oct. 14, 1994

[51] Int. Cl.[6] ..... B32B 31/00

[52] U.S. Cl. ..... 156/441.5; 156/442.1; 156/442.3; 156/578

[58] Field of Search ..... 156/441.5, 442.1, 156/442.2, 442.3, 578

[56] References Cited

U.S. PATENT DOCUMENTS

| | | | |
|---|---|---|---|
| 1,194,693 | 8/1916 | Allen | 156/442.2 |
| 2,121,166 | 6/1938 | Flynt | 156/441.5 |
| 2,749,689 | 6/1956 | Colley | 156/442.2 X |
| 4,643,123 | 2/1987 | Auerbach | 156/441.5 X |

*Primary Examiner*—James Engel
*Attorney, Agent, or Firm*—Bernard J. Murphy

[57] ABSTRACT

A flexible leaf causes the gummed flap of an envelope to enter a chamber in which a moistening element is exposed. In addition, a pivoted and spring-biased element yields upon engagement of the envelope spine therewith. Further movement of the envelope wipes the flap across the moistening element, and the spring-biased element presses the moistened flap against the body of the envelope.

7 Claims, 2 Drawing Sheets

FIG. 2
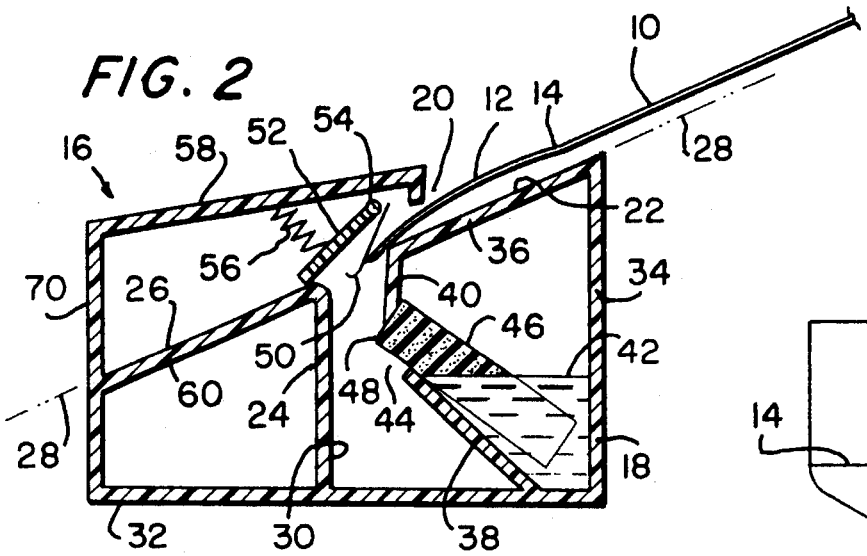
FIG. 1
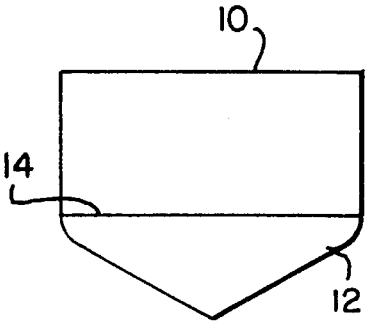
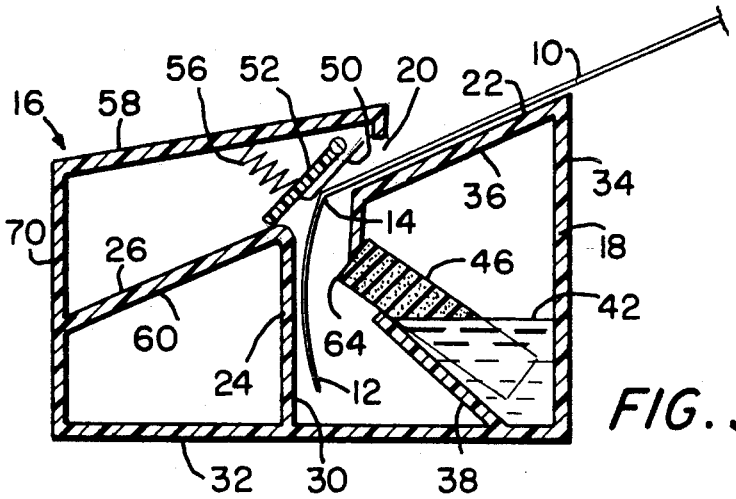
FIG. 3
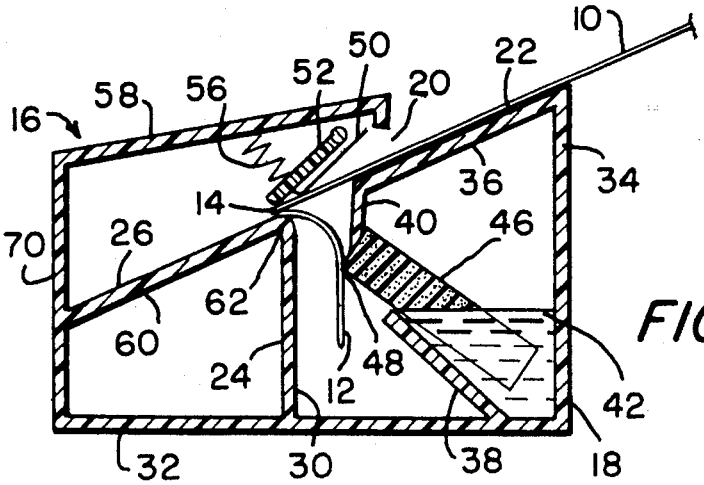
FIG. 4

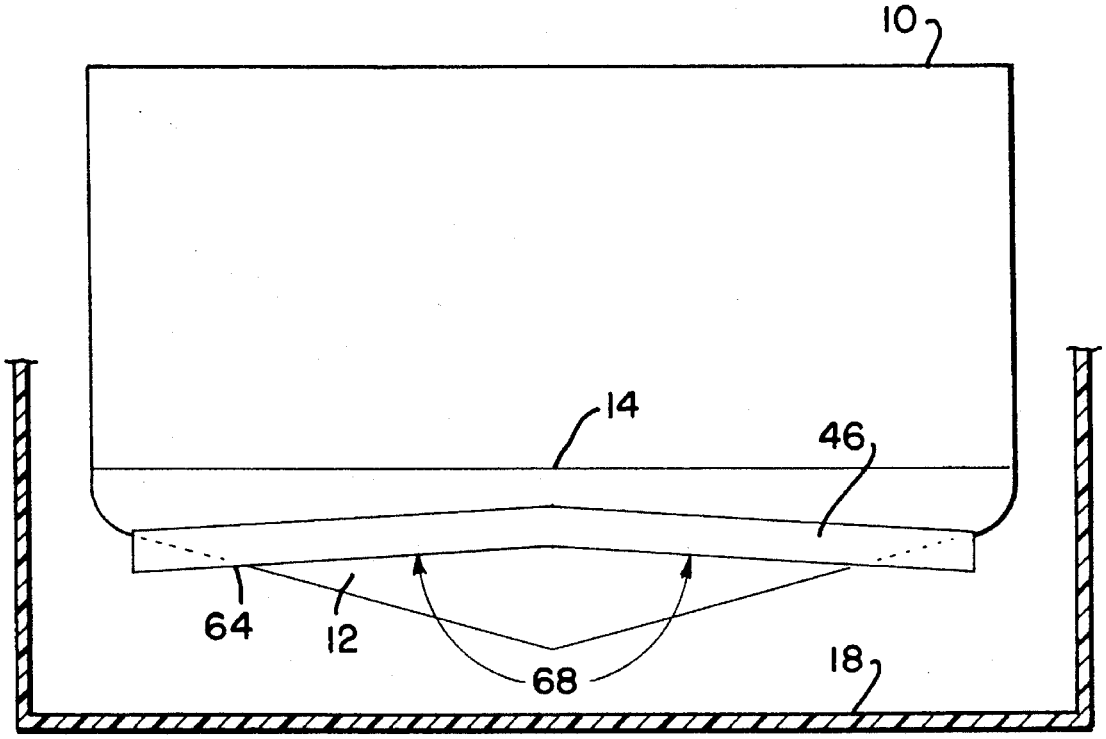
FIG. 6
FIG. 5
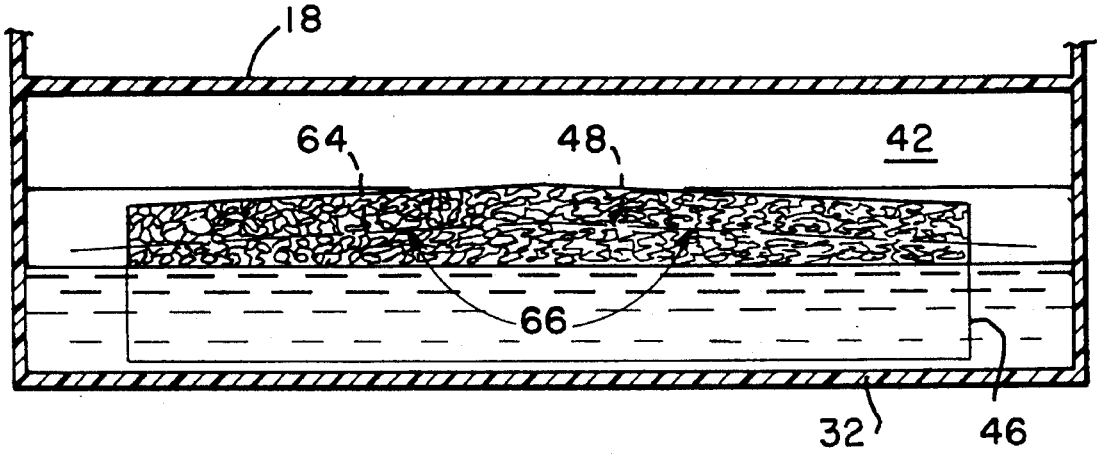

ENVELOPE-FLAP SEALING DEVICE

Envelope-flap sealing devices, which accept the gummed flap of an envelope, moisten the same, and press it onto a surface of its associated envelope to effect a sealing thereof, are rather complex and, accordingly, expensive to fabricate and maintain.

There has been a long felt need for an uncomplicated, envelope-flap sealing device, having a minimal of moving parts, and of simple efficiency. It is an object of this invention, then, to set forth just such a simple and efficient device to satisfy the aforesaid need.

It is particularly an object of this invention to disclose an envelope-flap sealing device comprising a housing; wherein said housing has an inlet opening formed therein for receiving an unsealed envelope therethrough; and a partition, wholly confined within said housing, having first and second wall surfaces; guide means, within said housing and interposed between said opening and said partition, for directing an envelope flap away from one of said surfaces; gating means, within said housing, for biasingly inhibiting access to the other of said surfaces; and means within said housing for moistening envelope flaps.

Further objects of this invention, as well as the novel features thereof, will become apparent from the following description, taken in conjunction with the accompanying figures, in which:

FIG. 1 is a plan view of an inverted envelope;

FIG. 2 is a cross-sectional view of the novel envelope-flap sealing device, according to an embodiment thereof, showing an envelope making an initial entry into the device;

FIG. 3 is a view like that of FIG. 2 in which, however, the flap of the envelope is shown fully deflected downwardly into the housing, and the envelope having made further entry into the housing;

FIG. 4 is another view like that of FIGS. 2 and 3 in which, now, the hinge or spine of the flap has pushed past the gating means, as the envelope makes still further entry into the housing, and the flap is drawn up against the edge of the sponge element;

FIG. 5 is a view showing the disposition of the sponge element in the reservoir; and FIG. 6 is an elevational view depicting the wipe of the envelope flap along the edge of the sponge element.

As shown in FIG. 1, a typical envelope 10, in inverted position, the same displaying the addressing side thereof, has a common gummed flap 12 which is hinged along a spine 14. The to-be-moistened, gummed side of the flap 12 is not visible, the same being the underlying side of the flap 12.

FIG. 2 depicts, in cross-section, the novel envelope-flap sealing device 16, according to an embodiment thereof. Device 16 comprises a housing 18 which has a slot 20 formed therein as an inlet opening through which to insert an envelope, such as envelope 10. The housing 18 has a planar surface 22 which supports the envelope 10 for its entry into the housing slot 20. Within the housing 18 is sited a partition 24. The partition has a first wall surface 26 which occupies a common plane 28 with the surface 22. A second wall surface 30 of the partition is substantially a vertical wall upstanding from a floor 32 of the housing 18. Floor 32, an end wall 34, diagonal wall 36 (which presents the planar surface 22), another diagonal wall 38 and a short, depending vertical wall 40 confine a water reservoir 42 therewithin. Walls 38 and 40 have a void 44 therebetween. A sponge 46 is disposed in the reservoir 42, and a protruding portion 48 thereof occupies the void 44.

A flexible leaf 50 is fixed at the upper end thereof (by means not shown) to an inner surface of the housing 18, and the depending lower end thereof normally is disposed, biasingly, against wall 40. Additionally, a planar element 52 is pivotably mounted, also to an inner surface of the housing 18, at 54. A compression spring 56, interposed between element 52 and a top wall 58 of the housing 18, biasingly holds element 52 against an inclined wall 60 (which presents the aforesaid first surface 26).

As shown in FIG. 2, the envelope 10 is inserted into the slot 20, flap first, with the gummed side of the flap 12 confronting the surface 22. Upon the flap 12 encountering the flexible leaf 50, the latter is deflected, slightly, away from the wall 40. However, the flap 12, for being a single thickness of paper, hasn't sufficient rigidity to deflect the leaf 50 fully away. As a consequence, the leaf 50 functions as a guide and directs the flap 12 downwardly, to a space alongside surface 30.

With further insertion of the envelope 10 into the housing 18, upon surface 22, the leaf 50 is encountered by the spine 14. In and of itself, the spine 14 has sufficient rigidity to deflect the leaf 50 away, and buttressed by the envelope contents, it moves the leaf 50 fully up against the planar element 52. More over, the spine 14, and the force of the envelope proper, with its relatively unyielding contents, force the planar element 52 to pivot, against the bias of the spring 56. FIG. 3 shows the leaf 50 pushed up against the planar element 52 by the spine 14 and the following portion of the envelope 10. In FIG. 4, now, the planar element 52 has yielded, in a sort of gating function, to allow the spine 14, and the following portion of the envelope 10, to move upon surface 26.

Surfaces 26 and 30, of the partition 24, meet at a juncture which defines a knee 62 thereat. As FIG. 4 shows, continued insertion of the envelope 10 into the housing, along surfaces 22 and 26, causes the flap 12 to slide upon and over the knee 62. This, in turn, causes the underlying, gummed side of the flap 12 to wipe across the protruding portion 48 of the sponge 46, and be moistened. With further entry of the envelope 10 into the housing 18, the gating, planar element 52, due to the bias of the spring 56, presses the now-moistened flap 12 against the underlying, confronting portion of the envelope 10 to seal the latter.

As shown, the protruding portion 48 of the sponge 46 is substantially right-angular in cross-section. Additionally, however, lengthwise thereof, the portion 48 comprises an edge 64 which defines an obtuse angle 66, as depicted in FIG. 5. More, the edge 64, as shown in FIG. 6, defines a second obtuse angle 68 relative to the spine 14 of the envelope 10. The angles 66 and 68 insure that only the gummed or glued areas of the flap 12 will be moistened, and further that envelopes which have a somewhat elliptical flap will be adequately sealed.

The sponge 46 can be a natural product or synthetic, but it must be sufficiently compliant so that, as the flap 12 is drawn across the edge 64 thereof, the edge will be slightly compressed (a) to yield up a sufficiency of moisture, and (b) to draw up water from the reservoir 42 after the flap 12 has travelled on and the edge 64 returns to its right-angular configuration.

After the flap 12 has been moistened and sealed against the underlying, confronting portion of the envelope 10 by the gating, planar element 52, the now sealed envelope 10 can be withdrawn through the slot 20, along surface 22, in this embodiment. Alternatively, in an alternative embodiment of the invention, the sealed envelope 10 could be withdrawn from the opposite side of the housing 18. The housing 18 has an end w-all 70, which supports a portion of the partition 24 thereat. Simply by forming a slot in wall 70, which fairs with the surface 26, the sealed envelope 10 could be passed through the housing 18 and deposited on the exterior thereof, adjacent to wall 70.

On balance, then, my novel, envelope flap sealing device 16 comprises a housing 18 having a slot 20 formed between a top or upper wall 58 and a planar surface defined by surfaces 22 and 26 of diagonal wall or plate 36 and inclined wall or plate 60, respectively. Walls or plates 36 and 60 are aligned along a same plane, to define the aforesaid planar surface as a path of envelope travel, and are separated therebetween to form a gap in said path. The flap moistening sponge 46 is located under the gap, the protruding portion thereof being exposed through the void 44 to moisten an envelope flap 12. The flexible leaf 50, located above the gap in the path of envelope travel, comprises means for deflecting the flap 12 through the gap, toward the sponge 46 for moistening. The planar element 52, located behind the leaf 50, relative to the travel of the envelope along the surfaces 22 and 26, comprises the means for pressing the moistened flap 12 closed against the envelope 10.

My device 16 is inordinately simple in structure and operation, having only three, movable, mechanical parts, namely: leaf 50, gating, planar element 52, and the biasing spring 56. Benefiting from my disclosure herein, others will recognize that it could be feasible to dispense with the spring 56 as well, by employing a gating element, in lieu of element 52, which is also flexible like leaf 50, albeit an element which has more stiffness than leaf 50, i.e., a flexible, gating element which too will deflect only on being addressed by the spine 14 and the body of the envelope 10 with its buttressing contents. Accordingly, while I have described my invention in connection with a specific embodiment thereof, it is to be clearly understood that this is done only by way of example, and not as a limitation to the scope of my invention, as set forth in the objects thereof, and in the appended claims.

I claim:

1. An envelope flap sealing device, comprising:

a housing having a slot formed between an upper wall and a planar surface of said housing; wherein said planar surface defines a path of envelope travel, and comprises two aligned plates separated therebetween by a gap; and envelope flap moistening means located under said gap;

a flexible deflecting means, located above said gap, and secured at one end thereof to an upper portion of said housing, for deflecting an envelope flap through said gap and into contact with said moistening means; and a planar element, located behind said deflecting means in said path of envelope travel, and pivotably mounted to said upper portion of said housing, for pressing the moistened flap closed.

2. An envelope flap sealing device, according to claim 1, wherein:

said slot is elongated; and said deflecting means comprises a leaf.

3. An envelope flap sealing device, according to claim 1, further including:

means biasingly engaging said planar element and restraining said planar element in contact with said planar surface.

4. An envelope flap sealing device, according to claim 3, wherein:

said element engaging and restraining means comprises a compression spring interposed between said upper wall and said planar element.

5. An envelope flap sealing device, according to claim 1, wherein:

said moistening means comprises a liquid reservoir formed within said housing;

said reservoir has an elongated void formed therein; and said moistening means further comprises an absorbent element set in said reservoir and having a portion thereof protruding through said void.

6. An envelope flap sealing device, according to claim 5, wherein:

said housing further has a vertical wall formed therein;

one of said plates and said wall meet at a given juncture which defines a knee thereat; and said knee comprises means, responsive to movement of an envelope upon said planar surface, for causing a flap of such envelope to wipe across said absorbent element.

7. An envelope flap sealing device, according to claim 5, wherein:

said absorbent element is elongated and occupies substantially all of said void with said protruding portion thereof;

said protruding portion comprises a substantially right-angular edge of said absorbent element; and said edge, lengthwise thereof, defines an obtuse angle.

* * * * *